United States Patent [19]

Griffith

[11] 4,236,638

[45] Dec. 2, 1980

[54] EMPTY BEVERAGE CAN CARRIER

[76] Inventor: Dwight N. Griffith, 4451 N. 15 Rd., Mesick, Mich. 49668

[21] Appl. No.: 60,262

[22] Filed: Jul. 25, 1979

[51] Int. Cl.[3] ..... B65D 67/02; B65D 85/62

[52] U.S. Cl. ..... 206/493; 206/159; 206/427; 224/45 AA; 224/45 P; 294/87 R; 294/87.2

[58] Field of Search ..... 206/427, 493, 159, 139; 224/45 P, 45 AA, 45 R; 294/87 R, 87.2

[56] References Cited

U.S. PATENT DOCUMENTS

| | | | |
|---|---|---|---|
| 1,252,226 | 1/1918 | Bonk et al. | 294/87 R |
| 2,747,914 | 5/1956 | Lyons | 224/45 AA |
| 3,136,419 | 6/1964 | Ruderian | 206/493 |
| 3,439,798 | 4/1969 | James | 224/45 R |
| 3,552,612 | 1/1971 | Greis | 224/45 P |
| 3,674,138 | 7/1972 | Gilmour | 206/349 |
| 3,896,929 | 7/1975 | Mills | 206/493 |
| 4,111,298 | 9/1978 | Mascia et al. | 294/87.2 |
| 4,136,772 | 1/1979 | Mascia et al. | 224/45 R |

*Primary Examiner*—William T. Dixson, Jr.
*Attorney, Agent, or Firm*—Krass & Young

[57] ABSTRACT

A carrier for empty beverage cans comprising a flat body having compressible projections extending from the opposite sides thereof to be thrust through the opening of the empty cans. A loop permits the body to be hung against a wall. Projections of specific shape are disclosed.

7 Claims, 2 Drawing Figures

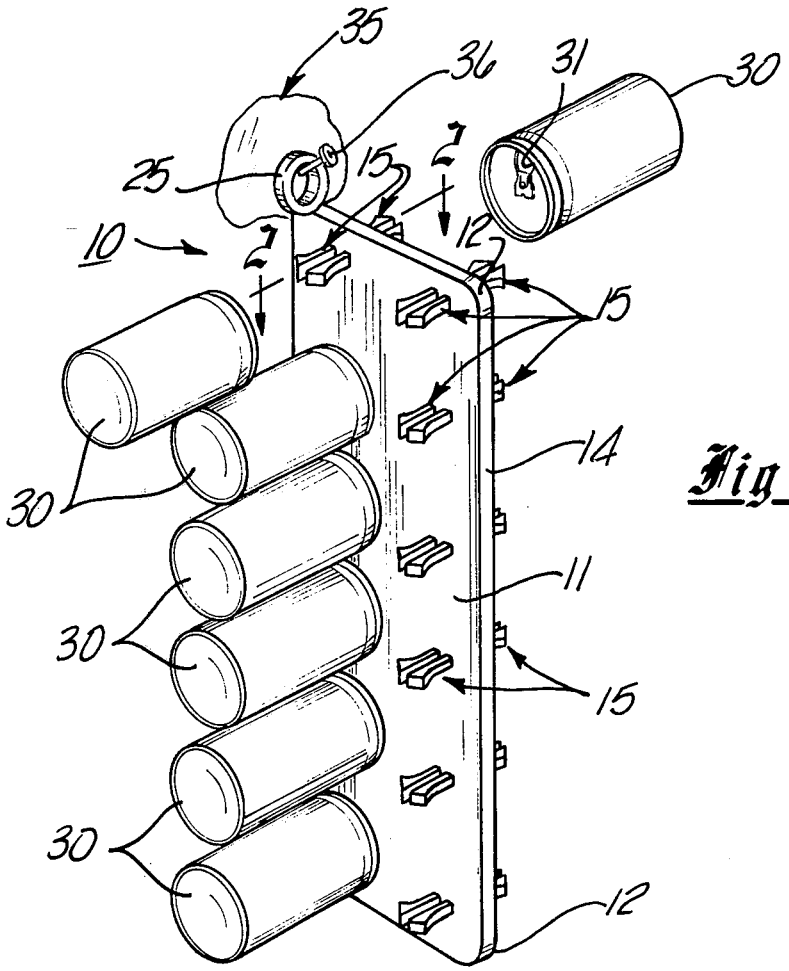
Fig-1
Fig-2
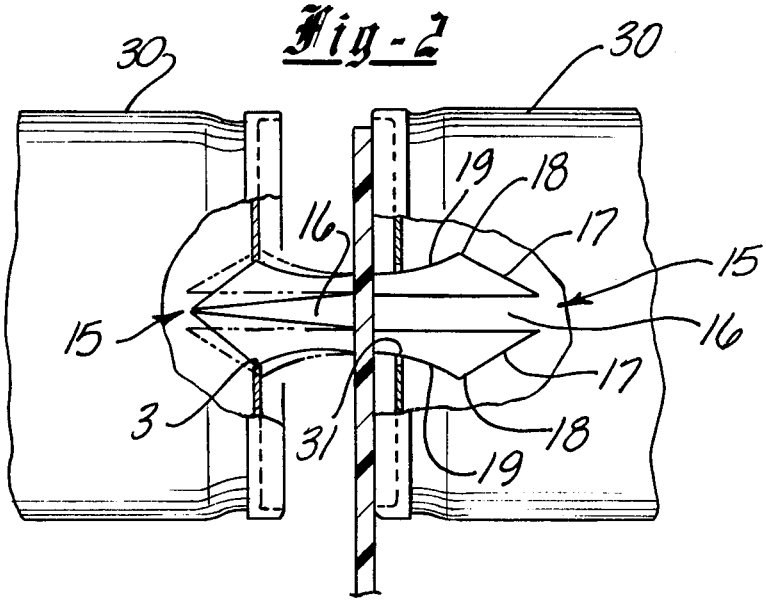

EMPTY BEVERAGE CAN CARRIER

INTRODUCTION

This invention relates to carriers for empty beverage cans and more particularly to a carrier on which the cans are disposed by causing projections on the carrier body to be thrust through the opening in the can tops.

BACKGROUND OF THE INVENTION

At the present time, returnable beverage cans are accumulated in receptacles such as boxes or bags for return to the place of purchase. This is an unsightly and inefficient method which generally requires floor space and may be cumbersome to transport. The prior art also shows various means for carrying full beverage cans. One example is shown in U.S. Pat. No. 4,136,772 to comprise a plastic sheet having rigidified edges and round openings adapted to embrace the top side surfaces of several cans.

The prior art further includes U.S. Pat. No. 2,747,914 which shows a carrier for bottles including a handle connected to a depending shaft from which hang a plurality of wire rods, each rod bearing a sponge on the end farthest from the shaft. One thrusts the sponge into the bottle and hopes that frictional forces hold the bottles on the wires during transportation of same.

BRIEF SUMMARY OF THE INVENTION

It is the object of this invention to provide a reusable carrier and storage device which will neatly store a number of empty beverage cans and at the same time act as a convenient carrier for returning the cans to the place of purchase.

In accordance with this invention there is provided a carrier and storage device for empty beverage cans which consists of a planar body having a plurality of deformable projections extending in spaced relation from each side of the body. Empty beverage cans may be affixed to these projections simply by thrusting the projections through the opening in the tops of the cans. In one embodiment, the projections have cam surfaces, a slot through the center to allow them to be compressed as they are passed through the can opening and then expand to effectively temporarily secure the beverage can to the carrier. The device is preferably constructed of a plastic material which can be injection molded in one piece, and includes a hanger loop which allows the body to hang against a wall, either with or without cans attached thereto.

BRIEF DESCRIPTION OF THE DRAWINGS

FIG. 1 is a perspective view of the can carrier with several empty beverage cans affixed and, FIG. 2 is a side detail of the can carrier showing the interaction between the can top and the camming projections.

DETAILED DESCRIPTION OF THE ILLUSTRATIVE EMBODIMENT

Referring to the drawings in detail, there is depicted in FIG. 1 a can carrier generally identified by the numeral 10 which is made up of a planar body 11 of rigid material having opposite flat sides and integrally formed therewith a plurality of spaced projections 15. A hanger/handle loop 25 is formed so as to lie in a plane at right angles to the plane of body 11 and to project from an edge thereof. In this fashion, the body 11 may be hung against a wall with cans in place. In the illustrated form of the invention, twenty-four projections 15 extend from the planar body 11, twelve on each side, but it is to be understood that a different number of projections 15 may be provided in other embodiments of the can carrier. The body 11 is generally rectangular with rounded corners 12 on the side opposite the wall 14.

The projections 15 are integrally attached to the planar body 11 and extend opposingly from both sides of said planar body 11. As seen in FIG. 1, the projections 15 are arrayed in a two by six matrix and spaced apart from center to center by at least the diameter of a standard 12-ounce beverage can 30. The column of projections closest to the wall side 13 is spaced at least the distance of the radius of a beverage can 30 from the wall side to allow said side to abut the wall 35 when hanging from the loop 25.

Reference is now made to FIG. 2 which depicts a top view of a typical projection 15. Each projection 15 is shaped similar to an arrowhead and dimensioned to be insertable into the opening 31 of a beverage can 30. The length of each projection is about one inch. The shoulder 18 of said projection is wider than the can opening 31 when relaxed so as to temporarily secure the beverage can 30 to the can carrier. The slot 16 facilitates the compression of the projection 15 during the engagement and disengagement of a beverage can 30 with the projection as shown in FIG. 2. The angular leading cam surface 17 guides the can opening 31 onto the projection 15 and acts as a cam to convert the longitudinal motion of the beverage can 30 into a pinching force on the projection. The concave tapered cam surface 19 acts in the same fashion to pinch the projection 15 during the disengagement of the can from the can carrier.

The hanger loop 25 extends upward vertically from a long edge of the planar body 11 with the opening of said loop being positioned perpendicular to the planar body, so as to allow hanging the device from a nail 36, or carrying by hand.

The can carrier is preferably formed of a plastic material which is substantially rigid yet having sufficient flexibility to allow deformation of the projections. The plastic material must also be elastic to accommodate reuse of the can carrier. The can carrier will preferably be formed in one piece by an injection molding process to minimize the unit cost of the device.

It is recognized that many modifications of this device may be made in the dimensions, structure of the planar body, and configuration of the projections and hanger means. I have set forth the preferred form of the invention and I am aware that modifications can be made without departing from the spirit of the invention.

The embodiments of the present invention in which an exclusive property or privilege is claimed are defined as follows:

1. A carrier and storage device for empty beverage cans comprising:

a substantially planar body of rigid material having two opposite, flat sides;

a plurality of elastically deformable, spaced projections integral with and extending horizontally from each of said sides;

each of said projections being insertable into the opening of an empty beverage can whereby said can is temporarily secured to the body by the compression of the projection as it passes through the opening followed by expansion of the projection after insertion.

2. A carrier as defined in claim 1 further including a hanger means extending from an edge of the planar body and at right angles thereto for supporting the carrier in a vertical orientation against a surface such as a wall.

3. A carrier and storage device as described in claim 1 made of molded plastic.

4. A carrier and storage device as described in claim 2, said planar body being rectangular in shape with rounded corners on the side opposite the wall for safety.

5. A carrier and storage device as described in claim 3, said projections being substantially in the shape of an arrowhead having:

a length on the order of one inch and, an angular leading surface for guiding a can opening over the projection and to act as a cam to pinch the projection during engagement;

a shoulder point wider than a beverage can opening at the end of the angular leading surface for retaining the beverage can;

a concave tapered surface from the shoulder point to the point at which the projection is connected to the planar body to act as a cam to pinch the projection during disengagement of said can with the projection; and a vertical slot through the center of the projection from the tip of the projection to the planar body for facilitating the compression of the projection.

6. A carrier and storage device as described in claim 5, said projections being arranged in a two by six rectangular matrix on both sides of the planar body, with the distance between the centers of said projections being at least the diameter of a conventional beverage can.

7. A carrier and storage device as described in claim 6, said hanger means in the shape of a ring extending upward from the wall side of the planar body, the plane of the ring being vertical and perpendicular to the planar body.

* * * * *